US006422282B1

(12) United States Patent
Meinke

(10) Patent No.: US 6,422,282 B1
(45) Date of Patent: Jul. 23, 2002

(54) APPARATUS FOR TREATING WEBS PRIOR TO SPLICING

(75) Inventor: Karsten Meinke, Mölln (DE)

(73) Assignee: Topack Verpackungstechnik, GmbH, Schwarzenbek (DE)

( * ) Notice: Subject to any disclaimer, the term of this patent is extended or adjusted under 35 U.S.C. 154(b) by 0 days.

(21) Appl. No.: 09/419,808

(22) Filed: Oct. 18, 1999

(30) Foreign Application Priority Data

Oct. 16, 1998 (DE) ..... 198 47 800

(51) Int. Cl.[7] ..... B65H 21/00

(52) U.S. Cl. ..... 156/505; 156/157; 156/502; 156/238; 156/541; 242/556.1

(58) Field of Search ..... 156/157, 502, 156/504, 505, 507, 234, 238, 541, 542; 242/551, 552, 555.3, 555.5, 556.1

(56) References Cited

U.S. PATENT DOCUMENTS

| | | | | |
|---|---|---|---|---|
| 3,765,992 A | | 10/1973 | Stageberg | |
| 3,974,007 A | | 8/1976 | Greve | |
| 4,986,285 A | | 1/1991 | Radzio et al. | |
| 5,385,622 A | * | 1/1995 | Klingebiel | 156/157 |
| 5,431,767 A | | 7/1995 | Koza et al. | |
| 5,632,285 A | | 5/1997 | Dahlgrün | |
| 5,772,150 A | * | 6/1998 | Spatafora | 156/504 X |

FOREIGN PATENT DOCUMENTS

| | | |
|---|---|---|
| DE | 43 03 171 | 8/1994 |
| DE | 94 16 843.1 | 1/1995 |
| EP | 0 181 280 A1 | 5/1986 |
| EP | 0 873 957 A1 | 10/1998 |

* cited by examiner

*Primary Examiner*—Mark A. Osele
(74) *Attorney, Agent, or Firm*—Venable; Robert Kinberg; Catherine M. Voorhees

(57) ABSTRACT

Apparatus for manipulating uniting bands having pairs of adhesive sides ahead of a splicer wherein the leader of a fresh web carrying one or more uniting bands is attached to the trailing end of an expiring web employs a base carrying a first reel which supplies a strip-shaped carrier of uniting bands, with one side of each uniting band adhering to the carrier, and a second reel which collects successive increments of the carrier subsequent to their separation from the uniting bands. The base further supports a spring-biased clamping member and is pivotable between a first position in which the carrier is remote from the leader of a fresh web, and intermediate position in which the clamping member begins to bias the leader of the fresh web against a back support, and a second position in which the other side(s) of a selected number of uniting bands contacts or contact the leader of the fresh web. The clamping member continues to urge the leader of the fresh web against the back support during a first stage of pivoting of the base back to the first position. The carrier becomes separated from the uniting band(s) adhering to the leader of the fresh web as soon as the base leaves its second position.

18 Claims, 3 Drawing Sheets

APPARATUS FOR TREATING WEBS PRIOR TO SPLICING

CROSS REFERENCE TO RELATED CASES

This application claims the priority of German patent application Serial No. 198 47 800.3 filed Oct. 16, 1998. The disclosure of the German patent application, as well as that of each United States and/or foreign patent and patent application mentioned in the specification of the present application, is incorporated herein by reference.

BACKGROUND OF THE INVENTION

The present invention relates to improvements in web splicers, and more particularly to improvements in apparatus for treating adhesive commodities ahead of the actual splicing station. Still more particularly, the invention relates to improvements in apparatus for transferring thin commodities, which comprise pairs of adherent sides, from a normally flexible strip-shaped carrier of such commodities to one side of a first web which is to be spliced to a second web by means of the transferred commodities.

Apparatus of the above outlined character are utilized in various types of machines or production lines for the making and/or processing of smokers' products, e.g., rod-shaped smokers' products. For example, it is customary to make plain cigarettes in a machine wherein a continuous rod-shaped filler of natural, reconstituted and/or substitute tobacco is draped into a continuous web of cigarette paper. Webs of convoluted cigarette paper are stored on reels, and the trailing end of a running cigarette paper web (which is being drawn off the core of a first or preceding reel) must be spliced to the leader or leading end of a (fresh) web which is convoluted onto the core of a (fresh) reel. Such mode of splicing (namely while the wrapping mechanism of the cigarette making machine continues to receive a web of cigarette paper) renders it possible to achieve pronounced savings, not only because the number of rejects (which are invariably produced in response to each starting and each stoppage of a cigarette maker) is greatly reduced but also because each stoppage of a modern high-speed cigarette maker involves huge losses in output.

Similar or analogous splicers are or can be utilized in machines for the making of filter mouthpieces for tobacco smoke, in so-called tipping machines wherein plain cigarettes, cigarillos or cigars are united with filter mouthpieces to obtain filter cigarettes, cigarillos or cigars of unit length or multiple unit length, and in cigarette packing machines wherein webs of (for example) cellophane, metallic foil and/or plastic foil are draped around arrays of plain or filter cigarettes (or other rod-shaped smokers' products).

Apparatus of the type to which the present invention pertains are employed ahead (upstream) of the aforedescribed or analogous splicers (for use in tobacco processing or numerous other plants) to apply to the leaders of successive fresh webs thin commodities in the form of patches of paper, plastic or other suitable material. Such commodities act as so-called uniting bands and, to this end, have first adhesive sides separably adhering to a normally strip-shaped carrier and second adhesive sides serving to adhere to the leaders of fresh webs. Once the first adhesive side of la uniting band has been separated from its carrier, it can serve to adhere to the trailing end of an expiring web.

The first step of utilizing such uniting bands (having pairs of adhesive sides) involves attachment of the exposed (second) adhesive side of at least one uniting band (the first adhesive side of which adheres to its carrier) to the leader of a fresh web, and the second step of the method involves separation of the first side of the uniting band from its carrier (i.e., while the second adhesive side already adheres and continues to adhere to the leader of a fresh web). The next-following (third) step constitutes the splicing of the leader of the fresh web to the trailing end of the expiring (preceding) web in that the first adhesive side is caused to contact the trailing end of the expiring web while the second adhesive side continues to adhere to the leader of the fresh web. The expiring (or expired) web then proceeds to entrain the leader of the fresh web into the wrapping mechanism of the web-consuming or processing machine.

Published German patent application Serial No. 43 03 171 A1 discloses an apparatus employing a carriage which is movable transversely of a fresh web (while the fresh web is at a standstill) along a linear path. The carriage supports a roller which serves to press the exposed adhesive-coated side(s) of one or more uniting bands on a strip-shaped carrier against the leader of a fresh web while the other side of each uniting band adheres to the carrier. The carrier is drawn off a supply reel in response to movement of the roller against the stationary fresh web, and a takeup reel collects the leading end of the carrier subsequent to transfer of one or more uniting bands onto the fresh web. The transferred uniting bands form a file or row extending transversely of the leader of the fresh web.

A drawback of the just described conventional apparatus for manipulating uniting bands having dual adhesive sides or surfaces is that they are rather complex, bulky and expensive. Moreover, such conventional apparatus (including those described in the aforementioned published German patent application) are designed exclusively for automated or automatic transfer of uniting bands. On the other hand, it is often desirable to employ an apparatus which can be operated automatically, semiautomatically, as well as or by hand. Furthermore, it is not always desirable to apply a series of two or more uniting bands to the leader of the fresh web (e.g., a web of wrapping paper including cigarette paper or the like) in such a way that the applied uniting bands form a file or row extending transversely of the leader of a fresh web, i.e., of the web which is to be spliced to the trailing end or to another portion of an expiring or (in the meantime) expired web.

OBJECTS OF THE INVENTION

An object of the invention is to provide (for the manipulation of thin commodities having first and second adhesive sides and being utilized in web splicers) an apparatus which is simpler, more compact, more reliable and less expensive than the aforedescribed and other conventional apparatus.

Another object of the invention is to provide an apparatus which is more versatile than heretofore known apparatus, for example, because it can be operated automatically (e.g., in response to signals from a sensor monitoring the supply of running (unexpired) web on an expiring reel, as well as by hand.

A further object of the invention is to provide an apparatus which can be installed in existing web-consuming or web-processing machines as a superior substitute for apparatus presently used in cigarette making, cigarette filter tipping, cigarette wrapping and/or other machines.

An addition object of the invention is to provide a novel and improved method of manipulating, in or ahead of a web splicer, uniting bands of the type having pairs of opposed adhesive sides or surfaces.

Still another object of the invention is to provide the above outlined apparatus with novel and improved means for reliably separating uniting bands from their carrier and for reliably attaching the thus separated uniting bands to predetermined portions (e.g., to the leaders) of webs of cigarette paper, cellophane, other plastic materials, tipping paper, wrapping paper and/or other types of webs which can be attached to preceding or next-following webs by means of an adhesive substance.

A further object of the invention is to provide a novel and improved combination of a web splicer and a uniting band dispensing or applying apparatus of the above outlined character.

Another object of the invention is to provide a machine or production line which processes running webs of wrapping material or the like and employs one or more splicers and uniting band-treating or processing apparatus of the above outlined character.

SUMMARY OF THE INVENTION

The invention resides in the provision of an apparatus for transferring thin commodities (such as small patches of paper or plastic sheet material, hereinafter called uniting bands) of the type having first adhesive sides contacting one side of an elongated carrier (e.g., an elongated flexible strip of paper or the like) and exposed second adhesive sides intended to contact an elongated web (e.g., the leader of a web of cigarette paper, tipping paper or wrapping paper of the type utilized in the tobacco processing industry). For example, once the leader of a fresh web of convoluted cigarette paper in a cigarette rod making machine has received one or more uniting bands, such uniting bands can be utilized to cause the leader of the fresh web to adhere to (i.e., to be reliably connected with) the trailing end of an expiring web of cigarette paper so that the leader of the fresh web can be entrained into the wrapping mechanism of the cigarette rod making machine. Reference may be had, for example, to FIG. 1 of U.S. Pat. No. 5,632,285 granted May 27, 1997 to Rolf Dahlgrün for "APPARATUS FOR MAKING FILTER TIPPED SMOKERS' PRODUCTS HAVING A NON-CIRCULAR CROSS-SECTIONAL OUTLINE".

The improved apparatus comprises means (e.g., one or more driven rollers) for intermittently advancing the web lengthwise along a predetermined path, a back support (e.g., an anvil or the like) for the web in a predetermined portion of the path, and means for moving the carrier between a first position in which the carrier is remote from the web section in the predetermined portion of the path and a second position in which the exposed second adhesive side of at least one uniting band on the carrier contacts the web section in the predetermined portion of the path.

The uniting bands at the one side of the carrier can be distributed in such a way that they jointly form one or more elongated files or rows of spaced-apart discrete uniting bands.

The moving means can include means for moving the carrier between the first and second positions in a plurality of stages which may not need not be of equal duration and which may but need not immediately follow each other (i.e., with or without intervals between successive stages). Such moving means can comprise a support (e.g., a plate-like support or base) which is movable between the first and second positions, and a retaining device which is movable with and relative to the support between extended (idle) and retracted (operative) positions. One of the aforementioned stages can include a movement of the support from the first position to an intermediate position in which the retaining device contacts the web in the predetermined portion of the path and urges the web against the back support while the web in such predetermined portion of the path is spaced apart from the exposed second adhesive side of at least one uniting band on the carrier. Another stage (particularly the stage immediately following the just described one stage) can include or involve a movement of the support from the intermediate position to the second position and relative to the retaining device (namely while the retaining device maintains the web at the back support) to thus move the exposed adhesive second side of at least one uniting band on the carrier into contact with the web section in the predetermined portion of the path.

The moving means can further comprise a guide for the carrier. Such guide is movable with the support, and the retaining device is preferably arranged to become disengaged from the web section in the predetermined portion of the path upon completion of movement of the support from the second position to the intermediate position.

The retaining device can comprise means for clamping the web against the back support in the predetermined portion of the path in the intermediate and second positions as well as between the intermediate and second positions of the support. Such retaining device can further comprise resilient means (e.g., one or more pre-stressed coil springs) for biasing the clamping means against the web while the support dwells in the second and intermediate positions as well as during movement of the support between the second and intermediate positions. More specifically, the resilient means can serve to yieldably bias the clamping means from a position (relative to the support) corresponding to the aforementioned retracted position to a position corresponding to the aforementioned extended position of the retaining device.

The retaining device is or can be adjacent the guide. The latter can be fixedly connected to the support, and the retaining device (and more specifically the clamping means of the retaining device) can be mounted on the support.

The support is or can be mounted in such a way that it is pivotable between its first and second positions.

As already mentioned above, the carrier can comprise an elongated strip carrying one or more files of discrete spaced-apart uniting bands. The apparatus for the transfer of uniting bands from such carrier can further comprise a first rotary reel provided on the moving means and serving to pay out convoluted strip (with one or more uniting bands thereon), and a manually or motorically rotatable second rotary reel serving to collect successive portions of the strip-shaped carrier which are devoid of uniting bands as a result of transfer of uniting bands onto the web. The guide of such apparatus can be provided on the support.

The apparatus can further comprise means (such as a friction brake or another suitable brake) which yieldably opposes undesirable rotation of the first reel in a direction to pay out (discharge) united band-carrying lengths of strip-shaped carrier.

The advancing means moves the web lengthwise in a predetermined direction. The carrier can extend in such direction to overlie the web section in the predetermined portion of the path in the second position of the carrier. This renders it possible to apply to the leader of the web a series of two or more uniting bands, e.g., uniting bands which are spaced apart from each other in the longitudinal direction of the web.

Furthermore, the advancing means can be arranged or set up to intermittently advance the web in the predetermined direction, preferably into a splicing unit wherein the uniting band-carrying leader of the web is spliced to the trailing end of a second web in a second portion of the path downstream of the aforementioned predetermined portion. Alternatively, the improved apparatus can be utilized to transfer one or more uniting bands to the trailing end of a first web to thus allow for attachment of such trailing end to the leader of a fresh web.

The back support can constitute a pneumatic table, i.e., it can comprise means for pneumatically attracting the web in the predetermined portion of the path.

The novel features which are considered as characteristic of the invention are set forth in particular in the appended claims. The improved apparatus itself, however, both as to its construction and the mode of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
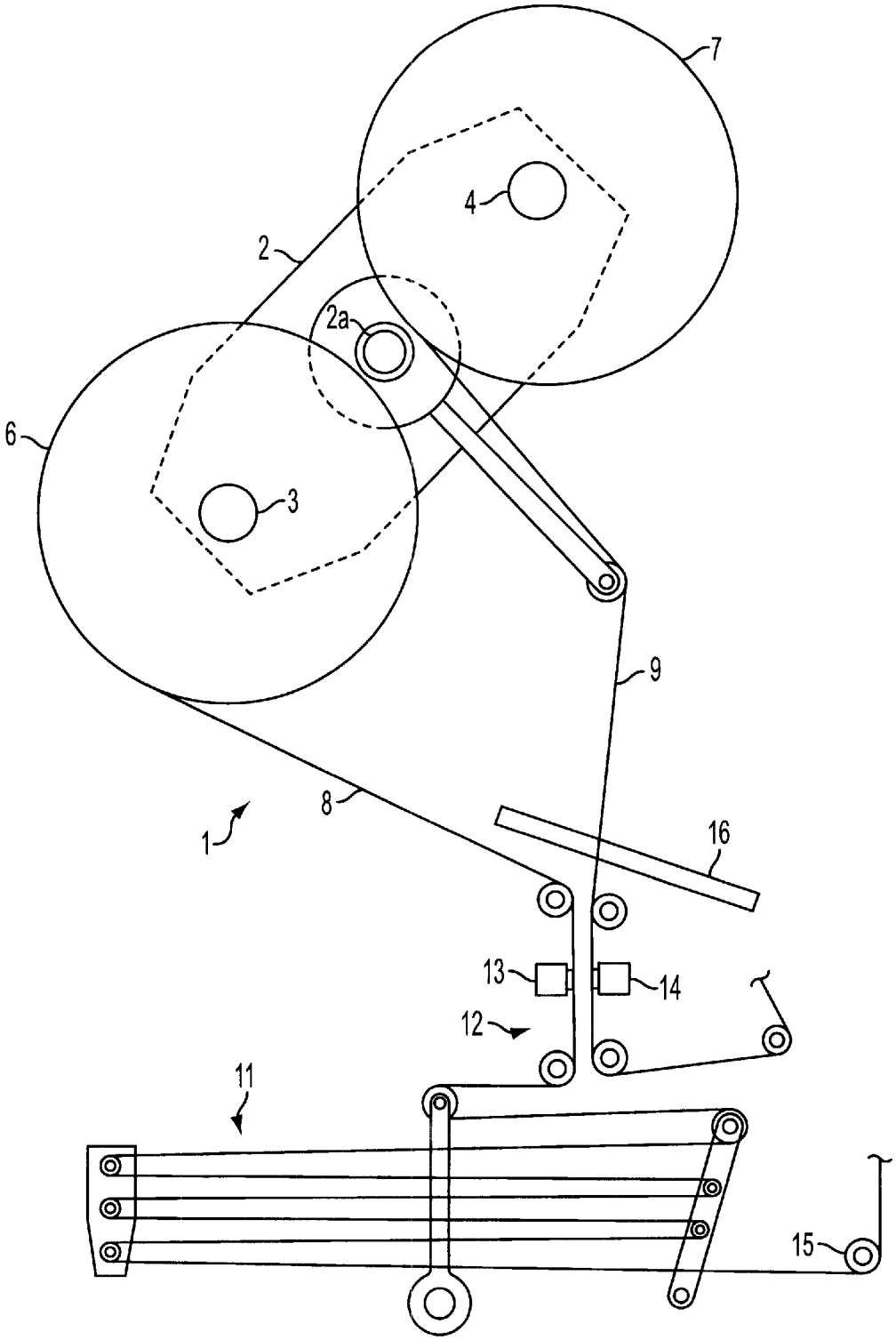
FIG. 1 is a schematic elevational view of a web splicer which is combined with an apparatus embodying one form of the present invention.

FIG. 1 shows certain component parts of a splicer 1 which can be utilized, for example, in a packing machine, in a cigarette making machine, in a filter rod making machine, in a filter tipping machine (e.g., of the type disclosed in the aforementioned '285 patent to Dahlgrün) or in any other machine wherein the trailing end of a running (expiring) web is to be spliced to the leader of a fresh web, e.g., a fresh web which is convoluted around the core of a reel or an analogous web storing and dispensing device.

A cigarette making machine employing a splicer similar to the one shown in FIG. 1 of the present application and capable of cooperating with the apparatus of the present invention is shown, for example, in FIG. 1 of U.S. Pat. No. 4,986,285 granted Jan. 22, 1991 to Andrzej Radzio et al. for "METHOD AND APPARATUS FOR ASCERTAINING THE DENSITY OF WRAPPED TOBACCO FILLERS AND THE LIKE".

A filter rod making machine which can employ the splicer of FIG. 1 cooperating with an apparatus embodying the present invention is disclosed, for example, in U.S. Pat. No. 3,974,007 granted Aug. 10, 1976 to Heinz Greve for "METHOD AND APPARATUS FOR THE PRODUCTION OF FILTER ROD SECTIONS OR THE LIKE".

A cigarette packing machine which can utilize a splicer in combination wth an apparatus embodying the present invention is known as COMPAS and is distributed by the assignee of the present application. The assignee also distributes machines known as C 90 film wrappers which employ splicers in conjunction with apparatus embodying the present invention and are utilized to wrap individual so-called soft cigarette packs or so-called hinge lid packs in transparent film.

Figure 2:
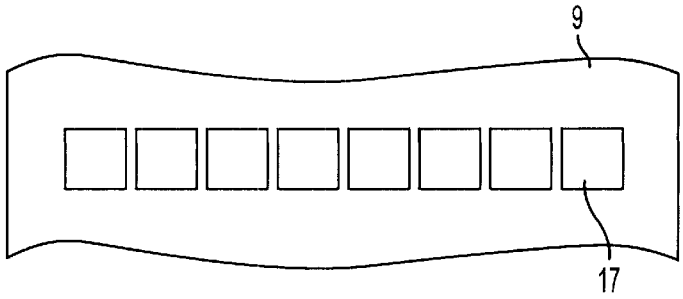
FIG. 2 is a fragmentary plan view of the leader of a fresh web supporting a file consisting of several uniting bands which are to splice the leader to the trailing end of an expiring or expired web, e.g., in a splicer of the type shown in FIG. 1.

The splicer 1 of FIG. 1 comprises a holder 2 which is indexible (at 2*a*) through angles of 180° and carries two parallel mandrels, 3, 4 for the hollow cores of two reels 6, 7. The reel 6 stores a supply of convoluted expiring web 8, and the reel 7 stores a supply of convoluted fresh web 9. The web 8 is drawn to a wrapping, packing or other web consuming station in a manner not forming part of the present invention. On its way to such station, the web 8 advances through a normally idle splicer 12 and thereupon through a customary magazine 11 wherein a certain length of the web is looped in a well known manner not forming part of this invention. The purpose of the magazine 11 is to compensate for eventual short-lasting differences between the rate of delivery of web 8 by the reel 6 and the rate of processing or consumption of such web at the aforementioned packing, wrapping or other consuming station. When the supply or running or expiring web 8 is nearly exhausted, the splicer 12 receives a signal to move at least one of two confronting splicing tools 13, 14 (known as hammers) toward the other splicing tool and to thus attach the leader of the fresh web 9 to the trailing end of the expiring web 8. The reasons for adherence of the leader of the fresh web 9 to the trailing end of the expiring web 8 will be appreciated upon perusal of the following detailed description of an apparatus 16 which embodies one form of the present invention and is installed upstream of the splicer 12 to provide one side of the web 9 with one or more thin commodities 17 (FIG. 2) which are transferred from a strip-shaped carrier 26 and enable the leader of the web 9 to adhere to the trailing end of the web 8 with a certain force. The just mentioned force must be strong enough to ensure that the trailing end of the web 8 can entrain the leader of the web 9 through the magazine 11 toward and into the processing or consuming station.

The means for monitoring the supply of expiring web 8 on the reel 6 is not shown in the drawings; such monitoring means can include a mechanical, optical or other suitable sensor which transmits a signal to and thus actuates the splicer 12 when the supply of web 8 is sufficiently exhausted to warrant actuation of the splicer 12. If the splicing necessitates a temporary stoppage of the advancement of web 8 (and thereupon the web 9) in the region of the splicing tools 13 and 14, the magazine 11 can pay out the stored supply of web 8 to thus avoid an interruption of delivery of web to the aforementioned consuming or processing station. The means for continuously drawing the web 8 (and thereafter the web 9) from the magazine 11 toward the processing or consuming station comprises one or more driven rollers. The roller 15 shown in FIG. 1 constitutes or forms part of the just discussed means for drawing web from the reel 6, thereupon from the reel 7, thereafter from the fresh reel which replaces the reel 6, and so forth.

Figure 3:
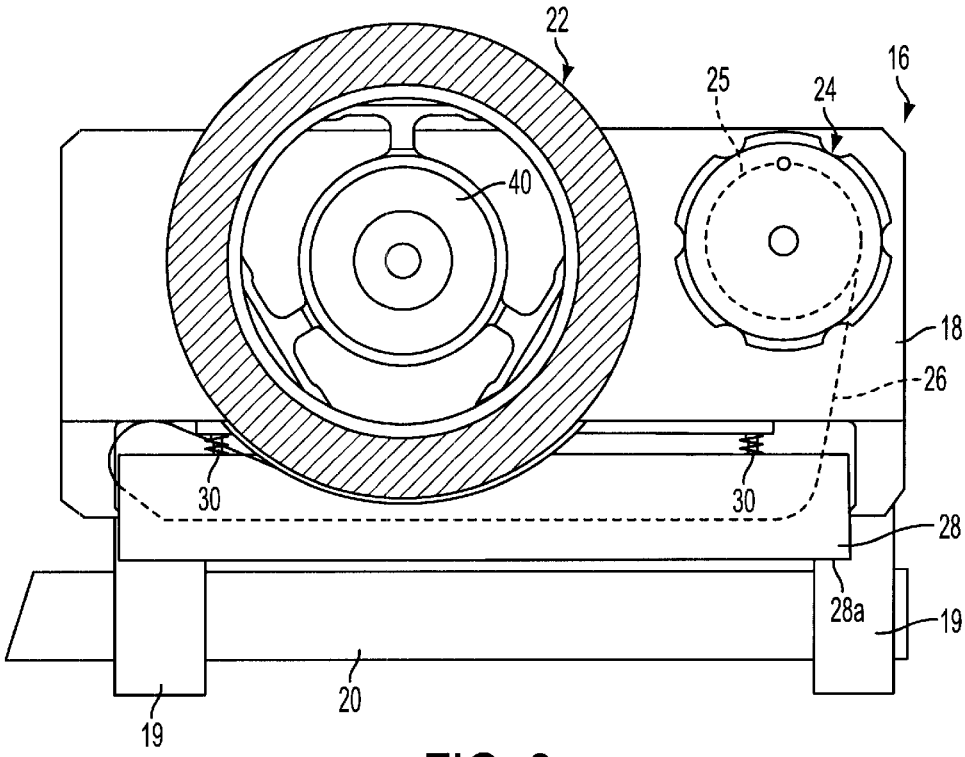
FIG. 3 is an enlarged elevational view of a portion of the apparatus of FIG. 1.
Figure 4:
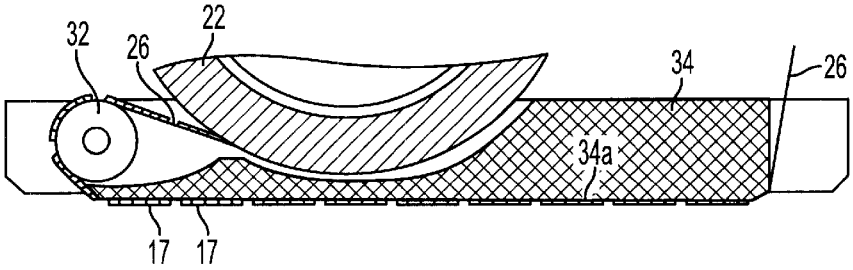
FIG. 4 is a fragmentary sectional view of a detail in the structure shown in FIG. 3.
Figure 5:
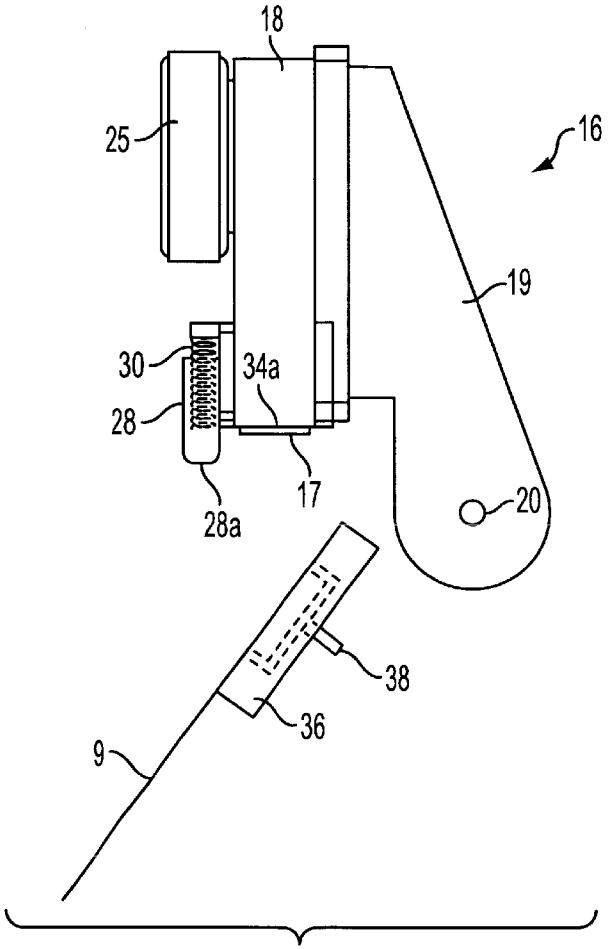
FIG. 5 is a smaller-scale view of the apparatus with the strip-shaped carrier of uniting bands in the first position and the retaining device of the moving means shown in the extended position.

All necessary details of the improved apparatus 16 (which is installed ahead or upstream of the splicer 12) are shown in FIGS. 3, 4, 5 and 6. This apparatus comprises a plate-like base 18 forming part of a means for moving the carrier 26 of discrete commodities 17 (hereinafter called uniting bands) between a first position which is shown in FIG. 5 and a second position shown in FIG. 6. The base 18 supports a first reel 22 which stores a supply of flexible strip-shaped carrier 26 for at least one file or row of uniting bands 17 (see the lower part of FIG. 4). The base 18 further supports a second reel 24 which serves to collect or take up the carrier 26, namely that length of the carrier 26 which has been relieved of uniting bands 17. The second reel 24 can be rotated by a motor (not shown) or by hand, namely by way of a knob 25 which is coaxial and rigid with the core of the reel 24 and is rotatable relative to the base 18.

A feature of the uniting bands 17 is that each such band has a first adhesive side or surface which adheres to the adjacent surface of that portion of the carrier 26 that is still convoluted on the core of the reel 22, and a second adhesive side or surface which is exposed at least while the respective portion of the carrier 26 is located between the reels 22 and 24. The second side or surface of a uniting band 17 adheres to one side of the web 9 when the treatment of such uniting band in the apparatus 16 is completed.

The base 18 carries two mandrels (e.g., in the form of stub shafts) which separably support the cores of the reels 22 and 24.

Figure 6:
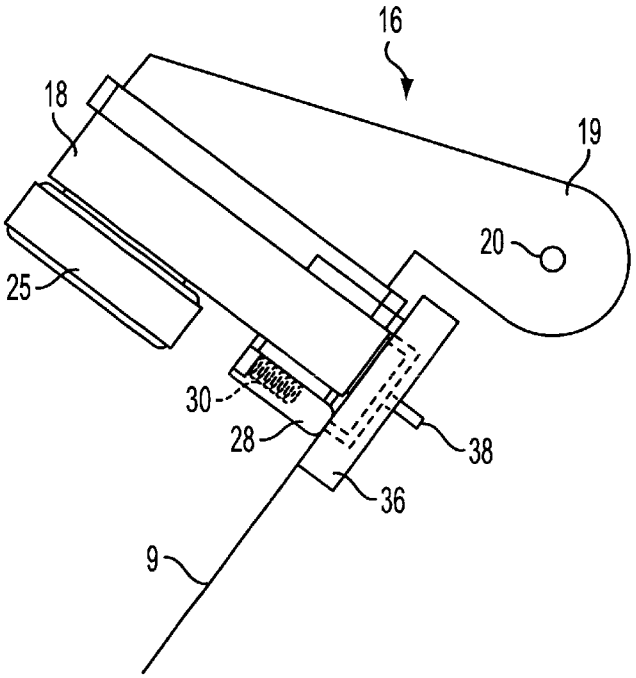
FIG. 6 shows the structure of FIG. 5 but with the carrier in the second position and the retaining device in the retracted position.

The base 18 of one piece with or connected to a pair of spaced-apart arms or links 19 which enable the base to pivot about the axis of a fixed shaft 20 (see FIGS. 3, 5 and 6) mounted in the frame of the splicer 12 or of the machine which embodies or cooperates with the splicer. FIGS. 5 and 6 show that the axis of the shaft 20 is parallel to the plane of the base 18.

FIGS. 3, 5 and 6 further show that the base 18 carries a retaining device including a clamping member 28 which is movable relative to the base between an extended or inoperative position (shown in FIG. 5) and a retracted or operative position shown in FIG. 6. The clamping member 28 is biased toward the extended position of FIG. 5 by suitable biasing means here shown as including a plurality of spaced-apart coil springs 30. The clamping member is or resembles an elongated plate having a relatively long narrow edge face 28*a* which extends beyond the adjacent edge faced of the base 18 in the extended position of the clamping member 28 but is flush with such edge face of the base in the retracted position of the member 28. The edge face 28*a* and the aforementioned edge face of the base 18 are at least substantially parallel to the axis of the shaft 20.

The exact manner in which the clamping member 28 of the retaining device shares the movements of the base 18 forms no part of the present invention. It suffices to say that the clamping member 28 is movable with as well as relative to the base 18. The movements of the clamping member 28 relative to the base 18 can take place at right angles to the edge face 28*a*. For example, the longitudinally spaced apart marginal portions of the clamping member 28 can be guided in suitable rails provided at the respective side of the base 18.

The leader of the strip-shaped carrier 26 extends beyond the periphery of the reel 22 and is trained over a deflecting roller 32 which directs the carrier 26 toward the exposed side (namely the underside, as viewed in FIG. 4) of a guide 34 carried by the base 18 adjacent the deflecting roller 32 and having an elongated surface 34*a* serving to guide that side of the carrier 26 which faces away from the file or row of uniting bands 17. The guide 34 can constitute a separately produced part which is affixed to the base 18; alternatively, the guide 34 can be of one piece with the base. That end of the surface 34*a* which is remote from the deflecting roller 32 serves to direct successive increments of the carrier 26 (namely of that portion of the carrier which is devoid of uniting bands 17) toward the second or takeup reel 24 on the base 18. The guide 34 is adjacent one side of the base 18 and the clamping member 28 overlies that side of the guide 34 which faces away from the base. The clamping member 28 has been omitted in FIG. 4 for the sake of clarity.

The elongated surface 34*a* of the guide 34 is or can be parallel to the axis of the shaft 20. Thus, the surface 34*a* is or can be parallel to the surface 28*a* of the clamping member 28.

The reference character 40 denotes in FIG. 3 a suitable brake (e.g., a friction brake) which prevents uncontrolled unwinding of the carrier 26 (with uniting bands 17 thereon) from the core of the reel 22. The second reel 24 on the base 18 preferably cooperates with a suitable freewheel (not shown) which enables the reel 24 to rotate in one direction, namely in a direction to collect that portion of the carrier 26 which has been relieved of uniting bands 17 during dwell at the underside of the surface 34*a* of the guide 34.

FIGS. 5 and 6 show that a portion of the path for the fresh web 9 is adjacent a back support 36, e.g., a so-called pneumatic table having a plurality of suction ports attracting the adjacent side of the web 9. To this end, the ports of the back support or table 36 are connected to a suction generating device (such as the suction side of a fan, not shown) by at least one suction conduit 38. When in the first position of FIG. 5, the moving means including the base 18 is remote from that portion of the fresh web 9 which overlies the pneumatic table or back support 36 for a portion of the fresh web 9. The clamping member 28 is adjacent to and bears upon the neighboring surface of the web 9 when the base 18 is caused to pivot about the axis of the shaft 20 and to thus move the edge face 28*a* toward that portion of the fresh web 9 which overlies the back support 36.

The operation of the illustrated apparatus 16 is as follows:

When the reel 6 on the mandrel 3 of the pivotable holder 2 still contains a reasonable supply of convoluted running or expiring web 8, the base 18 of the moving means for the carrier 26 and its reel 22 is maintained in the first position of FIG. 5 in which the coil springs 30 maintain the clamping member 28 in its extended position (namely in a position in which the edge face 28*a* of the member 28 extends beyond the plane surface 34*a* of the guide 34) and the uniting bands 17 at the surface 34*a* are remote from that portion or section of the fresh web 9 which overlies the back support 36.

The base 18 can be pivoted by hand or by a suitable motor (e.g., in response to a signal preceding the aforediscussed signal to actuate the splicer 12) to move from the first position of FIG. 5 to an intermediate position (not shown) in which the edge face 28*a* of the depressible clamping member 28 reaches the exposed side of that section of the fresh web 9 which overlies the back support 36. The just described first stage of pivotal movement of the base 18 from the first position of FIG. 5 is followed by a second stage which involves a depression of the clamping member 28 against the opposition of the coil springs 30 and a movement of the uniting band(s) 17 at the plane 34*a* of the guide 34 into contact with the confronting surface of the fresh web 9. The surface 34*a* is preferably parallel with the exposed side or surface of that portion or section of the web 9 which overlies the back support 36 when the base 18 reaches the second position of FIG. 6. At such time, each uniting band 17 at the surface 34*a* adheres to the fresh web 9 while still adhering to the corresponding portion of the carrier 26, namely that portion of the carrier which overlies the surface 34*a* of the guide 34.

The springs 30 yield (i.e., they store additional energy) during the aforementioned second stage of movement of the base 18 from the first position of FIG. 5 to the second position of FIG. 6. Such yielding of the springs 30 is caused by the clamping member 28 which moves relative to the base 18 from the extended position of FIG. 5 to the retracted position of FIG. 6; in the latter (retracted) position, the edge face 28*a* is flush or practically flush with the plane surface 34*a* of the guide 34. The bias of the edge face 28*a* upon the web 9 increases in response to increasing compression of the springs 30 so that the web 8 is reliably held against movement relative to the back support 36 not later than when the exposed side(s) of the uniting band(s) 17 at the surface 34*a* reach and adhere to the web 9 at the support 36.

The next stage of operation of the apparatus 16 involves a pivoting of the base 18 about the axis of the shaft 20 from the second position of FIG. 6 toward the first position of FIG. 5. The first stage of such return movement of the base 18 entails a dissipation of energy by the springs 30 while the exposed surface 34*a* of the guide 34 moves away from the confronting surface(s) or side(s) of the freshly transferred uniting band(s) 17 (FIG. 4 shows a total of nine bands 17). The quantities and/or attracting forces of adhesive substances coating the two sides or surfaces of each uniting band are selected in such a way that the force with which a uniting band adheres to that section of the web 9 which overlies the back support 36 exceeds the force with which such uniting band was caused to adhere to its carrier 26. Such selection of quantities and/or attracting forces of adhesives coating the two sides of a uniting band having two adhesive surfaces or sides is well known in the art which employs uniting bands corresponding to the uniting bands 17. The forces with which a uniting band 17 adheres first to the carrier 26 and thereupon to a fresh web 9 can be selected by the aforediscussed selection of the quantities and/or by the finish of those sides or surfaces of the webs 9 and/or carrier 26 which come in contact with the respective sides of a uniting band. Still further, the just discussed forces can be regulated by appropriate selection of the material of the web 9 and/or the carrier 26.

The provision of a retaining device including the aforementioned clamping member 28 and the springs 30 constitutes an optional but highy desirable feature of the apparatus 16 because the springs 30 continue to bias the web 9 against the back support 36 during that (first) stage) of return movement of the base 18 to the position of FIG. 5 when the carrier 26 is in the process of being pulled away from the uniting bands 17 adhering to the web 9 as a result of movement of the base 18 to the second position of FIG. 6.

Of course, the evacuation of air from the ports in that side or surface of the back support 36 which abuts the adjacent section of the web 9 also contributes to retention of the web 9 in the position of FIG. 6 during pivoting of the base 18 from the second position of FIG. 6 back to the first position of FIG. 5. Thus, the pneumatic table or back support 36 cooperates with the clamping member 28 during that stage of return movement of the base 18 while the clamping member 28 moves relative to the base 18 from the fully retracted position of FIG. 6 to the aforementioned intermediate position in which the edge face 28*a* is about to cease to contact the web 9.

Once the edge face 28*a* has become disengaged from the web 9, the drive means (including or constituted by the driven roller 15 or a discrete drive means, such as a manually operated drive means) is actuated to advance the web section (and the freshly transferred uniting bands 17 thereon) from the position of overlap with the back support 36 to the splicing position between the tools 13, 14 of the splicer 12. The next step involves a movement of the tool 13 and/or 14 toward the other tool to thus splice the leader of the web 9 to the trailing end of the web 8 so that the web 9 can enter the magazine 11 on its way toward the processing or consuming station. If necessary, the splicing step can be followed by a trimming step involving removal of a surplus of web 9 forwardly of the freshly obtained splice and/or removal of a surplus of web 8 behind the splice.

In order to advance one or more uniting bands 17 to the position(s) of register with the exposed surface 34*a* of the guide 34 (preparatory to the next-following splicing operation involving attachment of the trailing end of the web 9 to the leader of a fresh web which has replaced the web 8 and subsequent to pivoting of the holder 2 through 180°), the reel 24 is rotated by the knob 25 in the direction permitted by the aforementioned free-wheel. The brake 40 ensures that the carrier 26 is properly tensioned between the reels 22, 24, i.e. in the region of the roller 22 and adjacent the surface 34*a* of the guide 34.

The feature that a simple (preferably) pivotal movement of the moving means including the base 18 from the first position of FIG. 5 to the second position of FIG. 6 and thereupon away from the second position suffices to ensure reliable transfer of one or more uniting bands 17 from the carrier 26 onto the web 9 (or the follower of web 9) contributes significantly to simplicity, reliability and lower cost of the improved apparatus. The clamping member 28 brings about the aforediscussed advantage that the web 9 continues to remain in optimum contact with the back support 36 during that important stage of movement of the base 18 back to its first position of FIG. 5 when the springs 30 ensure that the edge face 28*a* of the member 28 bears upon the web 9 while the carrier portion overlying the surface 34*a* of the guide 34 moves away from the freshly transferred uniting band(s) 17, i.e., away from the confronting surface of the web section abutting the back support 36.

The extent to which the improved apparatus is or can be automated depends upon the intended use of the associated splicer. For example, a fully automated combination of a splicer and the improved apparatus might be desirable advisable or necessary when the splicer is used in a high speed machine for the making of plain or filter cigarettes, filter mouthpieces or cigarette packs, such as the aforementioned soft or hinge lid packs for arrays of four, ten or twenty cigarettes.

The improved apparatus can attach to the leader of a fresh web (such as the web 9 shown in FIG. 2) a single uniting band 17, two uniting bands or more than two (e.g., eight) uniting bands. A row or file of simultaneously applied or transferred uniting bands 17 can extend longitudinally or transversely of the leader of the fresh web, depending on the dimensions of the uniting bands, the magnitude of the force which is required to reliably connect the leader of a fresh web to the trailing end of an expiring or expired web, and/or other parameters. It is often advisable to transfer a row or file of uniting bands onto the leader of a fresh web in such a way that the row extends longitudinally of the fresh web. This necessitates such orientation of the surface 34*a* of the guide 34 that it extends longitudinally of the fresh web section which is adjacent the back support 36.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of web splicing apparatus and, therefore, such adaptations should and are intended to be comprehended within the meaning and range of equivalence of the appended claims.

What is claimed is:

1. An apparatus for transferring thin commodities onto an elongated web, each commodity having a first adhesive side contacting one side of an elongated carrier and an exposed second adhesive side for transferring the commodity to the elongated web, said apparatus comprising:

means for intermittently advancing the web lengthwise along a predetermined path;

a back support for the web in a predetermined portion of said path; and means for moving the elongated carrier between a first position in which the carrier is remote from the web in said predetermined position of said path and a second position in which the exposed second adhesive side of the thin commodity on the carrier contacts the web in said predetermined portion of said path, said moving means including a support movable between the first and second positions, a retaining device movable with and relative to said support between extended and retracted positions, means for moving the support between said first and second positions in a plurality of stages, and a guide for the carrier which is movable with said support where said retaining device contacts the web in its retracted position and is disengaged from the web in the predetermined portion of said path by movement from the retracted position to the extended position upon completion of movement of said support from said second position to an intermediate position.

2. The apparatus of claim 1, wherein the commodities at said one side of the carrier together form at least one file of spaced-apart discrete commodities.

3. The apparatus of claim 2, wherein the commodities are uniting bands.

4. The apparatus of claim 1, wherein the carrier includes an elongated flexible strip.

5. The apparatus of claim 1, wherein one of the plurality of stages includes a movement of said support from said first position to the intermediate position in which said retaining device contacts the web in said predetermined portion of said path while the web is spaced apart from the exposed second side of at least one commodity on the carrier, another of said stages includes a movement of said support from said intermediate position to said second position and relative to said retaining device, while said retaining device maintains the web at said back support, to thus move the exposed adhesive second side of at least one commodity on the carrier into contact with the web in said predetermined portion of said path.

6. The apparatus of claim 1, wherein said retaining device comprises means for clamping the web against the back support in said predetermined portion of said path in the intermediate and second positions as well as between said intermediate and second positions of said support.

7. The apparatus of claim 6, wherein said retaining device further comprises resilient means for biasing said clamping means against the web while said support dwells in said second and intermediate positions as well as during movement of said support between said second and intermediate positions.

8. The apparatus of claim 6, wherein said back support comprises an anvil.

9. The apparatus of claim 1, wherein said retaining device is adjacent said guide.

10. The apparatus of claim 1, wherein said guide is connected with said support.

11. The apparatus of claim 1, wherein said retaining device is mounted on said support.

12. The apparatus of claim 1, wherein said support is pivotable between said first and second positions.

13. The apparatus of claim 1, wherein the carrier includes an elongated strip and further comprising a first rotary reel provided on said moving means and arranged to pay out convoluted strip, and a second rotary reel arranged to collect successive portions of the strip which are devoid of commodities as a result of transfer of commodities onto the web.

14. The apparatus of claim 13, wherein said guide is provided on said support.

15. The apparatus of claim 13, further comprising means for braking said first reel.

16. The apparatus of claim 1, wherein said advancing means comprises means for moving the web in a predetermined direction and the carrier extends in said direction and overlies the web in said predetermined portion of said path in the second position of said carrier.

17. The apparatus of claim 1, wherein said advancing means is arranged to intermittently advance the web in a predetermined direction, and further comprising means for splicing the web to a second web in a second portion of said path downstream of said predetermined portion as seen in said predetermined direction.

18. The apparatus of claim 1, wherein said back support comprises means for pneumatically attracting the web in said predetermined portion of said path.

* * * * *